US010247116B2

(12) United States Patent
Dekar et al.

(10) Patent No.: US 10,247,116 B2
(45) **Date of Patent: *Apr. 2, 2019**

(54) HYDROCARBON VAPOR START TECHNIQUES USING A PURGE PUMP AND HYDROCARBON SENSOR

(71) Applicant: FCA US LLC, Auburn Hills, MI (US)

(72) Inventors: Joseph Dekar, Jackson, MI (US); Roger C Sager, Munith, MI (US); James J Daley, Jackson, MI (US); William B Blomquist, Lake Orion, MI (US); Jeffrey P Wuttke, Sterling Heights, MI (US); Russell J Wakeman, Canton, MI (US); Adam Fleischman, White Lake, MI (US); Ronald A Yannone, Jr., Clinton, MI (US); Luis Del Rio, Ann Arbor, MI (US); Mark L Lott, Webberville, MI (US); Edward Baker, Livonia, MI (US); Michael T Vincent, Novi, MI (US); Wei-Jun Yang, Ann Arbor, MI (US); Aikaterini Tsahalou, Shelby Township, MI (US)

(73) Assignee: FCA US LLC, Auburn Hills, MI (US)

( * ) Notice: Subject to any disclaimer, the term of this patent is extended or adjusted under 35 U.S.C. 154(b) by 211 days.

This patent is subject to a terminal disclaimer.

(21) Appl. No.: 15/164,464

(22) Filed: May 25, 2016

(65) Prior Publication Data

US 2017/0342917 A1 Nov. 30, 2017

(51) Int. Cl.
*F02M 1/00* (2006.01)
*F02D 41/00* (2006.01)
(Continued)

(52) U.S. Cl.
CPC ..... *F02D 41/004* (2013.01); *F02D 41/003* (2013.01); *F02D 41/0032* (2013.01);
(Continued)

(58) Field of Classification Search
CPC ..... F02M 37/0023; F02M 37/0029; F02M 37/025; F02M 25/0836; F02M 2025/0863;
(Continued)

(56) References Cited

U.S. PATENT DOCUMENTS 3,888,223 A 6/1975 Mondt
5,390,645 A 2/1995 Cook et al.
(Continued)

FOREIGN PATENT DOCUMENTS

DE 10040574 A1 2/2002
WO 20050016680 A2 2/2005
WO 2015049157 A1 4/2015

OTHER PUBLICATIONS

U.S. Appl. No. 15/164,479, filed May 25, 2016, Roger C. Sager et al.
(Continued)

*Primary Examiner* — John Kwon
(74) *Attorney, Agent, or Firm* — Ralph E. Smith

(57) ABSTRACT

An evaporative emissions (EVAP) control system for a vehicle includes a purge pump configured to pump fuel vapor to an engine of the vehicle via a vapor line and a purge valve. The system includes a hydrocarbon (HC) sensor disposed in the vapor line and configured to measure an amount of HC in the fuel vapor pumped by the purge pump to the engine via the vapor line. A controller is configured to: detect an imminent cold start of the engine and, in response to the detecting, perform the cold start of the engine by controlling at least one of the purge pump and the purge valve, based on the measured amount of HC, to deliver a desired amount of fuel vapor to the engine, which decreases HC emissions by the engine.

19 Claims, 4 Drawing Sheets

(51) Int. Cl.

| | |
|---|---|
| ***F02D 41/06*** | (2006.01) |
| ***F02N 99/00*** | (2010.01) |
| ***F02M 25/08*** | (2006.01) |
| *F02M 33/02* | (2006.01) |
| *F02M 21/02* | (2006.01) |

(52) U.S. Cl.
CPC ..... *F02D 41/0035* (2013.01); *F02D 41/0042* (2013.01); *F02D 41/0045* (2013.01); *F02D 41/062* (2013.01); *F02D 41/064* (2013.01); *F02M 25/08* (2013.01); *F02M 25/0836* (2013.01); *F02M 25/0854* (2013.01); *F02N 99/008* (2013.01); *F02M 21/0278* (2013.01); *F02M 21/0287* (2013.01)

(58) Field of Classification Search
CPC ..... F02D 2250/02; F02D 41/0032; F02D 41/004; F02D 41/0045; F02D 19/0621
USPC ... 123/510, 516, 518–520, 198 D, 357, 698; 73/118.02, 861.01, 861.04
See application file for complete search history.

(56) References Cited

U.S. PATENT DOCUMENTS

| | | | | |
|---|---|---|---|---|
| 6,318,345 | B1 | 11/2001 | Weber et al. | |
| 6,321,727 | B1 | 11/2001 | Reddy et al. | |
| 6,659,087 | B1 * | 12/2003 | Reddy | F02D 41/0045 123/357 |
| 6,769,418 | B1 | 8/2004 | Reddy | |
| 7,077,112 | B2 | 7/2006 | Mitani et al. | |
| 7,566,358 | B2 | 7/2009 | Hart et al. | |
| 8,689,613 | B2 | 4/2014 | Perry | |
| 9,752,521 | B2 * | 9/2017 | Dudar | F02D 41/064 |
| 2003/0110836 | A1 | 6/2003 | Cho | |
| 2005/0240336 | A1 * | 10/2005 | Reddy | F02D 41/0045 701/103 |
| 2015/0019066 | A1 | 1/2015 | Dudar et al. | |
| 2015/0083089 | A1 | 3/2015 | Pearce et al. | |
| 2015/0322901 | A1 * | 11/2015 | Kragh | F02M 25/08 123/520 |
| 2016/0194999 | A1 * | 7/2016 | Hakeem | F01P 7/10 123/41.05 |
| 2017/0082038 | A1 * | 3/2017 | Dudar | F02M 25/0836 |

OTHER PUBLICATIONS

U.S. Appl. No. 15/164,470, filed May 25, 2016, Roger C. Sager et al.
U.S. Appl. No. 15/164,462, filed May 25, 2016, Joseph Dekar et al.
International Search Report and Written Opinion dated Aug. 9, 2017 for International Application No. PCT/US2017/031865, International Filing Date May 10, 2017.

* cited by examiner 412
416
With Vapor Start
Without Vapor Start
Injector Pulse Width
Engine Speed (RPM)
420
Purge Pump Speed (RPM)
404
Purge Valve Duty Cycle
408
Port Temperature
Time
Key-On, Pre-Crank
Cranking
Engine Running

HYDROCARBON VAPOR START TECHNIQUES USING A PURGE PUMP AND HYDROCARBON SENSOR

FIELD

The present application generally relates to evaporative emissions (EVAP) control systems and, more particularly, to an EVAP control system and method for hydrocarbon (HC) vapor start of an engine using a purge pump and an HC sensor.

BACKGROUND

Conventional evaporative emissions (EVAP) control systems include a vapor canister and vapor transport lines. The vapor canister traps fuel vapor that evaporates from liquid fuel (e.g., gasoline) stored in a fuel tank of the vehicle. Engine vacuum is typically utilized to deliver the fuel vapor from the vapor canister to the engine through the vapor transport lines and into intake ports of the engine. When an engine is off (e.g., during engine cold starts), however, there is no engine vacuum. The specific composition or concentration of the fuel vapor is also unknown. Accordingly, while such EVAP control systems work for their intended purpose, there remains a need for improvement in the relevant art.

SUMMARY

According to a first aspect of the invention, an evaporative emissions (EVAP) control system for a vehicle is presented. In one exemplary implementation, the system includes a purge pump configured to pump fuel vapor trapped in a vapor canister to an engine of the vehicle via a vapor line and a purge valve when engine vacuum is less than an appropriate level for delivering fuel vapor to the engine, the fuel vapor resulting from evaporation of a liquid fuel stored in a fuel tank of the engine; a hydrocarbon (HC) sensor disposed in the vapor line and configured to measure an amount of HC in the fuel vapor pumped by the purge pump to the engine via the vapor line; and a controller configured to: detect an imminent cold start of the engine; and in response to the detecting, perform the cold start of the engine by controlling at least one of the purge pump and the purge valve, based on the measured amount of HC, to deliver a desired amount of fuel vapor to the engine, wherein delivery of the desired amount of fuel vapor during the cold start of the engine decreases HC emissions by the engine.

According to a second aspect of the invention, a method for HC vapor start of an engine is presented. In one exemplary implementation, the method includes detecting, by a controller, an imminent cold start of the engine and, in response to detecting the imminent cold start of the engine: receiving, by the controller and from an HC sensor, a measured amount of HC in fuel vapor in fuel vapor being pumped by a purge pump from a vapor canister to the engine via a vapor line and a purge valve when engine vacuum is less than an appropriate level for delivering fuel vapor to the engine; and performing, by the controller, the cold start of the engine by controlling at least one of the purge pump and the purge valve, based on the measured amount of HC, to deliver a desired amount of fuel vapor to the engine, wherein delivery of the desired amount of fuel vapor during the cold start of the engine decreases HC emissions by the engine.

In some implementations, the controller is configured to detect the imminent cold start of the engine by detecting a set of cold start preconditions that are each indicative of the imminent cold start of the engine.

In some implementations, one of the set of cold start preconditions is an ambient temperature being less than the cold start threshold. In one exemplary implementation, the cold start threshold is approximately 40 to 50 degrees Fahrenheit.

In some implementations, one of the set of cold start preconditions includes the measured amount of HC being greater than a threshold indicative of a minimum amount of HC for performing the cold start of the engine. In one exemplary implementation, one of the set of cold start preconditions includes (i) a key-on event has occurred that is indicative of an engine-off to engine-on transition, (ii) the purge pump has spooled to greater than a minimum speed threshold, and (iii) the HC sensor is on.

In some implementations, the controller is further configured to perform the cold start of the engine by commanding fuel injectors of the engine to supply liquid fuel to the engine in addition to the desired amount of fuel vapor. In some implementations, the controller is configured to command the fuel injectors to operate at a minimum pulse width when performing the cold start of the engine.

In some implementations, the controller is further configured to, after performing the cold start of the engine, command fuel injectors of the engine to supply a desired amount of liquid fuel to the engine. In some implementations, the controller is further configured to, after performing the cold start of the engine, control at least one of the purge pump and the purge valve to deliver fuel vapor to the engine in addition to the desired amount of liquid fuel via the fuel injectors.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings referenced therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DETAILED DESCRIPTION

Figure 1:
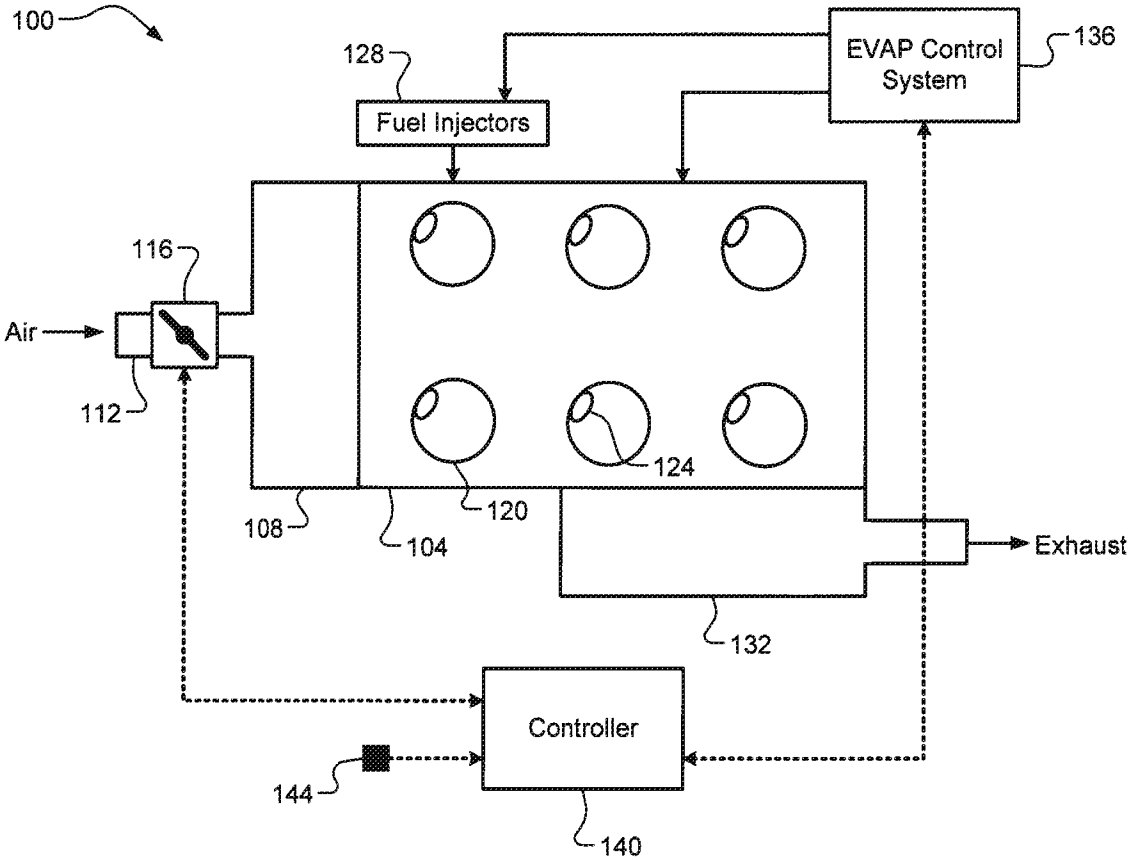
FIG. 1 is a diagram of an example engine system including an evaporative emissions (EVAP) control system according to the principles of the present disclosure.

Engine emissions are typically the greatest during engine cold starts (e.g., ambient temperature less than 75 degrees Fahrenheit). This is due to the fact that, during engine cold starts, engine components (lubricating fluids, catalysts, etc.) have not reached their optimal operating temperatures. More particularly, as fuel is vaporized via port injection, it comes in contact with cold intake port walls and/or intake valves, which causes some of the vaporized fuel to be condensed and returned to a liquid state. After combustion, this liquid fuel is exhausted as raw unburnt fuel, which is also known as hydrocarbon (HC) emissions. The HC is sent to an exhaust treatment system (e.g., a catalytic converter) in order to be oxidized to carbon dioxide ($CO_2$) and water ($H_2O$). This conversion, however, cannot occur until the reacting component is hot enough.

Evaporative emissions (EVAP) control systems are typically configured to deliver fuel vapor (from a fuel tank) that is trapped (in a vapor canister) to an engine via vapor transport lines. As fuel (e.g., gasoline) evaporates inside a fuel tank, the vapor canister (e.g., a charcoal surface) captures the fuel vapor. Components of fuel vapor (methane ($CH_4$), ethane ($C_2H_2$), propane ($C_3H_3$), butane ($C_4H_{10}$), etc.) are highly combustible and thus fuel vapor could potentially increase combustion within cylinders of the engine and decreases engine emissions (HC, nitrogen oxides (NOx), carbon monoxide (CO), etc.). For these reasons, and due to the fact that the fuel vapor is already in a vapor state, it is ideal for cold start combustion.

Conventional EVAP control systems, however, rely upon engine vacuum to deliver fuel vapor. These systems, therefore, may be inoperable for providing fuel vapor to the engine when the engine is off and there is no vacuum (e.g., an engine cold start). The specific composition or concentration of (e.g., amount of HC in) the fuel vapor is also unknown, which results in less accurate control. Accordingly, improved EVAP control techniques are presented. The disclosed systems/methods are operable when there is no engine vacuum (i.e., engine off) or less than a minimum engine vacuum required by conventional EVAP control systems. In one exemplary implementation, the disclosed system includes a purge pump configured to pump fuel vapor that is captured in the vapor canister to the engine and an HC sensor for measuring an amount of HC in the fuel vapor pumped by the purge pump.

By implementing the purge pump and the HC sensor, the disclosed EVAP control techniques are configured to supply the engine with a desired amount of fuel vapor corresponding to a desired amount of HC. This is particularly useful, for example, during engine-off periods (e.g., engine cold starts) where no engine vacuum exists to supply the fuel vapor to the engine. Another benefit is improved/faster catalyst light-off by heating up exhaust treatment components more quickly. The phrase catalyst light-off refers to a temperature at which a catalyst begins to actively react with exhaust gas in order to decrease emissions. Thus, one specific control technique involves controlling the purge pump based on measurements from the HC sensor to supply the engine with the desired amount of fuel vapor for achieving these objectives during an engine cold start, which is herein also referred to as an "HC vapor start."

Referring now to FIG. 1, an example engine system 100 is illustrated. The engine system 100 includes an engine 104 that is configured to combust an air/fuel mixture to generate drive torque. The engine draws air into an intake manifold 108 through an induction system 112 that is regulated by a throttle valve 116. The air in the intake manifold 108 is distributed to a plurality of cylinders 120 via respective intake ports 124. While six cylinders are shown, the engine 104 could have any number of cylinders. Fuel injectors 128 are configured to inject liquid fuel (e.g., gasoline) via the intake ports 124 (port fuel injection) or directly into the cylinders 120 (direct fuel injection). While not shown, it will be appreciated that the engine 104 could include other components, such as a boost system (supercharger, turbocharger, etc.).

Intake valves (not shown) control the flow of the air or air/fuel mixture into the cylinders 120. The air/fuel mixture is compressed by pistons (not shown) within the cylinders 120 and combusted (e.g., by spark plugs (not shown)) to drive the pistons, which rotate a crankshaft (not shown) to generate drive torque. Exhaust gas resulting from combustion is expelled from the cylinders 120 via exhaust valves/ports (not shown) and into an exhaust treatment system 132. The exhaust treatment system 132 treats the exhaust gas before releasing it into the atmosphere. An EVAP control system 136 selectively provides fuel vapor to the engine 104 via the intake ports 124. While delivery via the intake ports 124 is shown and discussed herein, it will be appreciated that the fuel vapor could be delivered to the engine 104 directly into the cylinders 120.

The EVAP control system 136 includes at least a purge pump (not shown) and an HC sensor (not shown). The EVAP control system 136 is controlled by a controller 140. The controller 140 is any suitable controller or control unit for communicating with and commanding the EVAP control system 136. In one exemplary implementation, the controller 140 includes one or more processors and a non-transitory memory storing a set of instructions that, when executed by the one or more processors, cause the controller 140 to perform a specific fuel vapor delivery technique. The controller 140 is configured to receive information from one or more vehicle sensors 144. Examples of the vehicle sensors 144 include an ambient pressure sensor, an altitude or barometric pressure sensor, an engine coolant temperature sensor, and a key-on sensor.

Figure 2:
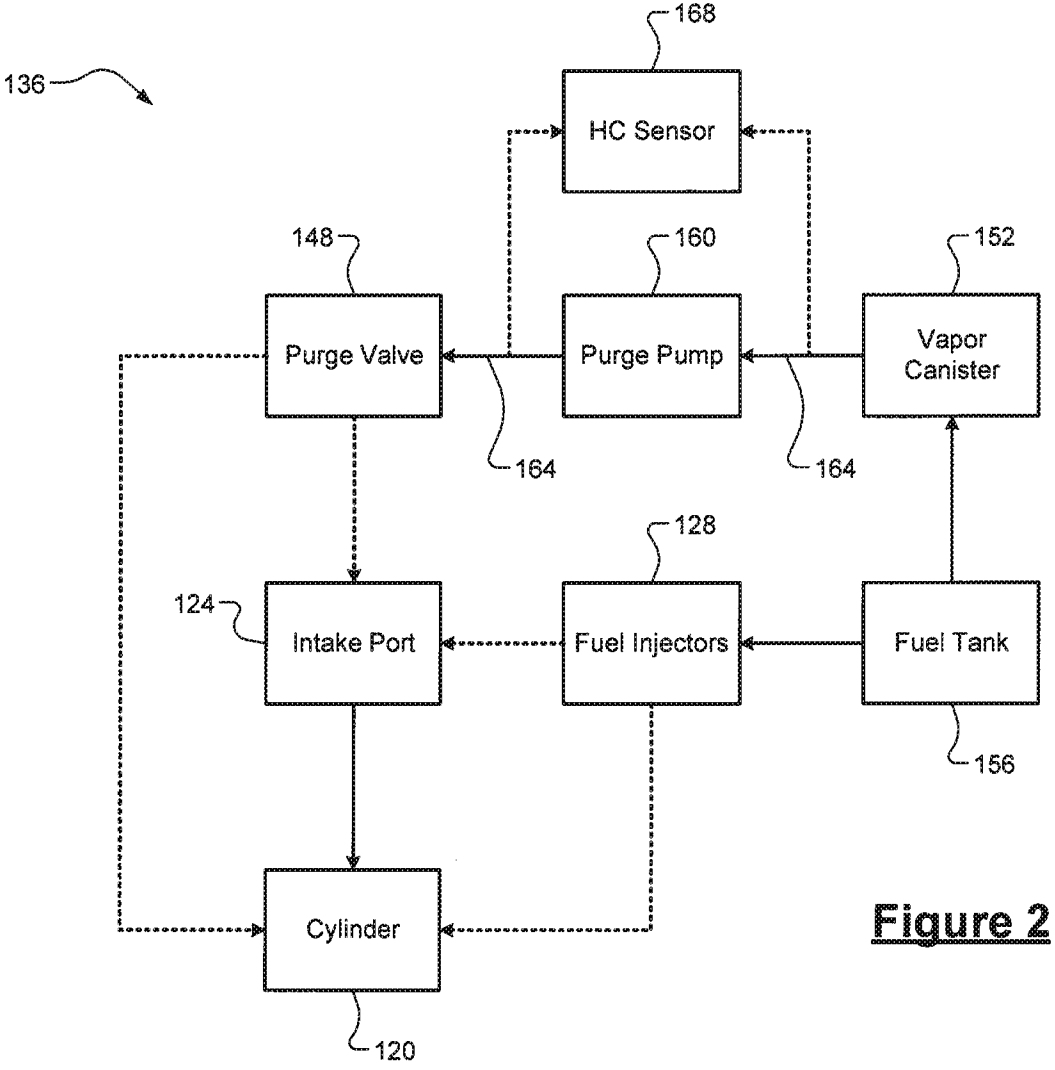
FIG. 2 is a functional block diagram of an example configuration of the EVAP control system according to the principles of the present disclosure.

Referring now to FIG. 2, a functional block diagram of an example configuration of the EVAP control system 136 is illustrated. While the EVAP control system 136 is only shown with respect to a single intake port 124 and single cylinder 120 of the engine 104, it will be appreciated that the fuel vapor could be supplied to all of the intake ports 124 and/or cylinders 120. The EVAP control system 136 is configured to deliver fuel vapor to the intake ports 124 of the engine 104 via purge valves 148. For example, the purge valves 148 could be disposed within holes or apertures in a wall of the intake ports 124. As previously mentioned, it will be appreciated that the purge valves 148 could be configured to deliver the fuel vapor directly to the cylinders 108, e.g., via different holes or apertures. One example of the purge valves is a butterfly-type valve, but it will be appreciated that any suitable valve configured to regulate the flow of pressurized fuel vapor could be utilized.

The EVAP control system 136 includes a vapor canister 152 that traps fuel vapor that evaporates from liquid fuel stored in a fuel tank 156. This fuel vapor can be directed from the fuel tank 156 to the vapor canister via an evaporation line or duct 154. In one exemplary implementation, the vapor canister includes (e.g., is lined with) activated carbon (e.g., charcoal) that adsorbs the fuel vapor. While not shown, the vapor canister 152 could further include a vent device (e.g., a valve) that allows fresh air to be drawn through the vapor canister 152, thereby pulling the trapped fuel vapor with it. As previously discussed, conventional EVAP control systems utilize engine vacuum to draw this fresh air (and trapped fuel vapor) through the system for engine delivery.

In the illustrated EVAP control system 136, a purge pump 160 is configured to selectively pump the fuel vapor from the vapor canister 152 through vapor lines 164 to the intake ports 124 (via the purge valves 148). This pumping could be in conjunction with or without the use of drawn fresh air through the vapor canister 152. The purge pump 160 could be any suitable pump configured to pump the fuel vapor from the vapor canister 152 through vapor lines 164. An HC sensor 168 is disposed in the vapor lines 164 and configured to measure an amount of HC in the fuel vapor pumped by the purge pump 160. As shown, the HC sensor 168 could measure the amount of HC flowing into and/or out of the purge pump 160. The measured amount of HC is indicative of an amount of the fuel vapor that is combustible. Rather, the HC in the fuel vapor represents the highly combustible component of the fuel vapor.

As the purge valves 148 regulate the flow of the fuel vapor into the engine 104, the controller 140 is configured to control at least one of the purge pump 160 and the purge valves 148 to deliver the desired amount of fuel vapor to the engine 104. The control of the purge pump 160 could include controlling its rotational speed. The control of the purge valves 148, on the other hand, could include controlling their angular opening. For example, there may be a high amount of HC present in highly pressurized fuel vapor in the vapor lines 164, and thus the controller 148 may primarily actuate the purge valves 148 to deliver the desired amount of fuel vapor. In many situations, however, the controller 160 will perform coordinated control of both the purge pump 160 and the purge valves 148 to deliver the desired amount of fuel vapor (e.g., a desired amount of HC) to the engine 104.

By delivering this highly combustible fuel vapor to the engine 104, combustion improves and emissions decrease. As previously discussed, the controller 140 is also configured to control the fuel injectors 128 to deliver the liquid fuel from the fuel tank 156 to the engine 104. This liquid fuel injection could be either port fuel injection or direct fuel injection. In one exemplary implementation, the controller 140 is further configured to control the fuel injectors 128 to deliver the liquid fuel from the fuel tank 156 after a period of controlling at least one of the purge pump 160 and the purge valves 148 to deliver the desired amount of fuel vapor to the engine 104. This period, for example only, could be a cold start of the engine 104.

Various preconditions could be implemented for operating the EVAP control system 136. In one exemplary implementation, the controller 140 is configured to control at least one of the purge pump 160 and the purge valves 148 based on a measured ambient temperature. Another exemplary precondition is detecting a key-on event of the vehicle. For example, these preconditions could be indicative of a cold start of the engine 104. Other exemplary preconditions could also be utilized, such as the rotational speed of the purge pump 160 reaching a desired level (e.g., where adequate pumping can occur) and the HC sensor 168 being turned on. Another exemplary precondition could include the HC sensor 168 measuring an amount of HC greater than a minimum threshold for combustion by the engine 104. In other words, if there is too little HC in the fuel vapor, there could be no combustion benefit by delivering the fuel vapor to the engine 104.

Figure 3:
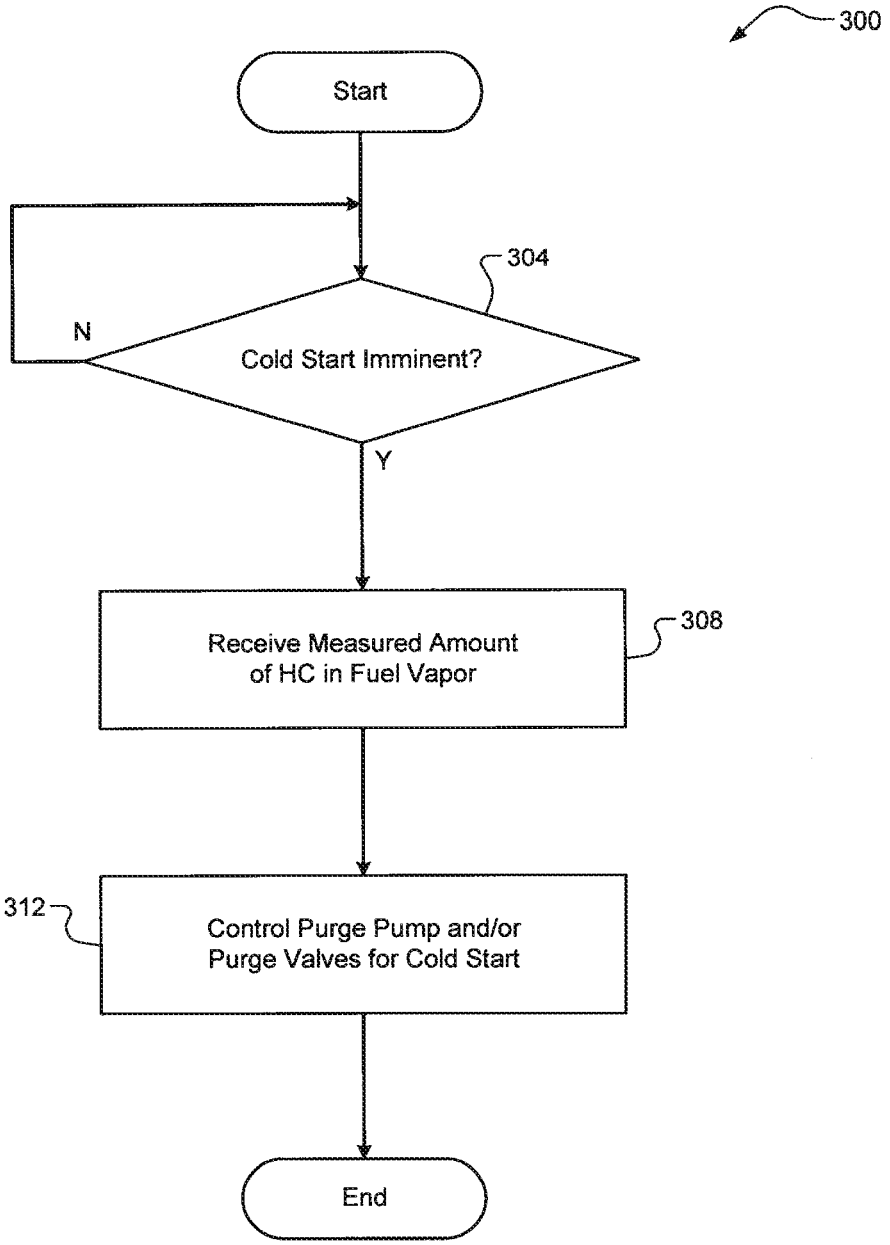
FIG. 3 is a flow diagram of an example method for hydrocarbon (HC) vapor start of an engine according to the principles of the present disclosure.

Referring now to FIG. 3, an example method 300 for HC vapor start of the engine 104 is illustrated. At 304, the controller 140 detects whether a cold start of the engine 104 is imminent. In one exemplary implementation, this detection is based on a set of cold start preconditions that are each indicative of the imminent cold start of the engine 104. Non-limiting examples of these preconditions include (i) ambient temperature or another suitable temperature (e.g., engine coolant temperature) below a cold start threshold (e.g., ~40-50 degrees Fahrenheit), (ii) the measured amount of HC being greater than a threshold indicative of a minimum amount of HC for performing the cold start of the engine 104, (iii) a key-on event has occurred that is indicative of an engine-off to engine-on transition, (iv) the purge pump 160 has spooled to greater than a minimum speed threshold, and (v) the HC sensor 168 is on. Any combinations of these and/or suitable cold start indicative preconditions could also be utilized.

When the controller 140 detects that the cold start of the engine 104 is imminent, the method 300 proceeds to 308. At 308, the controller 140 receives, from the HC sensor 168, the measured amount of HC. This step 308 could also be performed before step 304 (e.g., when the measured amount of HC is a cold start precondition). At 312, the controller 140 utilizes the measured amount of HC to control the purge pump 160 and/or the purge valves 148 to deliver a desired amount of fuel vapor to the engine 104. This desired amount of fuel vapor corresponds to an amount of fuel vapor that will decrease HC emissions in the exhaust gas produced by the engine 104 to a desired level. This is achieved by improving engine combustion and more quickly heating up components (e.g., catalysts) of the exhaust treatment system 132. When fuel vapor is no longer required (i.e., the cold start has ended), the method 300 then ends or returns to 304 for one or more additional cycles.

Figure 4:
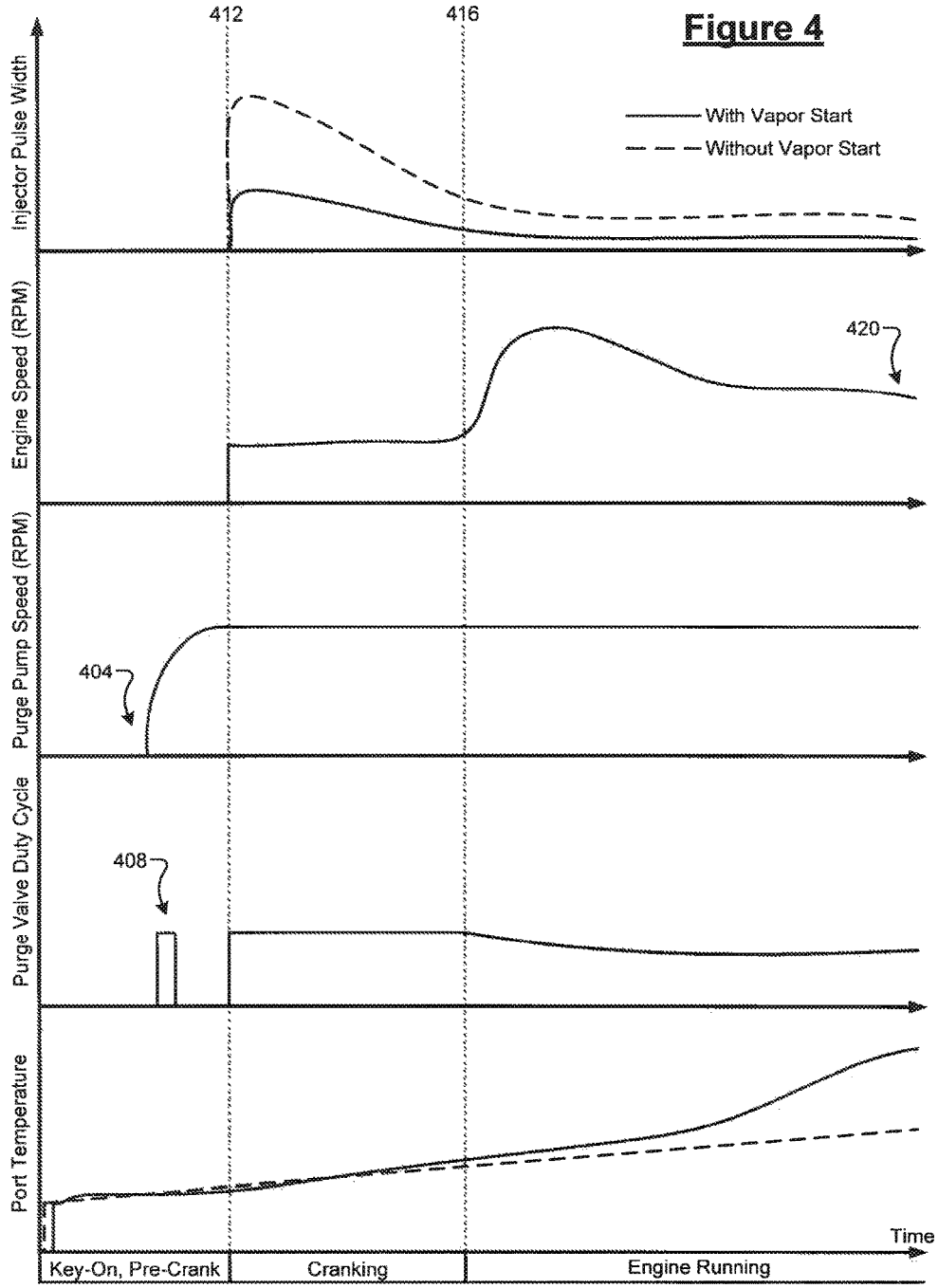
FIG. 4 is a timing diagram of the example method of FIG. 3.

Referring now to FIG. 4, an example timing diagram for the example method 300 of FIG. 3 is illustrated. During a key-on period prior to engine cranking, intake port temperature is relatively low, which is indicative of a cold start. During this period, the purge pump 160 is enabled and begins spooling at 404 and the purge valve 148 is temporarily opened at 408 causing a priming pulse to insure fuel vapor is ready for cold start cranking. Cranking to start the engine 104 begins at 412. As shown, the injector pulse width (i.e., liquid fuel injection) is decreased for HC vapor start to allow for the compensation of HC vapor. At the cranking to engine-on (running) transition 416, engine speed increases and thereafter levels off to an idle speed 420. The intake port temperature at the transition 416 is greater for HC vapor start compared to without HC vapor start, and this temperature continues to increase at a greater rate for HC vapor start due to the improved combustion of the fuel vapor in the engine 104.

As previously discussed, it will be appreciated that the term "controller" as used herein refers to any suitable control device or set of multiple control devices that is/are configured to perform at least a portion of the techniques of the present disclosure. Non-limiting examples include an application-specific integrated circuit (ASIC), one or more processors and a non-transitory memory having instructions stored thereon that, when executed by the one or more processors, cause the controller to perform a set of operations corresponding to at least a portion of the techniques of the present disclosure. The one or more processors could be either a single processor or two or more processors operating in a parallel or distributed architecture.

It should be understood that the mixing and matching of features, elements, methodologies and/or functions between various examples may be expressly contemplated herein so that one skilled in the art would appreciate from the present teachings that features, elements and/or functions of one example may be incorporated into another example as appropriate, unless described otherwise above.

What is claimed is:

1. An evaporative emissions (EVAP) control system for a vehicle, the system comprising:

a purge pump configured to pump fuel vapor trapped in a vapor canister to an engine of the vehicle via a vapor line and a purge valve when engine vacuum is less than an appropriate level for delivering fuel vapor to the engine, the fuel vapor resulting from evaporation of a liquid fuel stored in a fuel tank of the engine;

a hydrocarbon (HC) sensor disposed in the vapor line and configured to measure an amount of HC in the fuel vapor pumped by the purge pump to the engine via the vapor line; and a controller configured to:

detect an imminent cold start of the engine by detecting a set of cold start preconditions that are each indicative of the imminent cold start of the engine, wherein one of the set of cold start preconditions includes (i) a key-on event has occurred that is indicative of an engine-off to engine-on transition, (ii) the purge pump has spooled to greater than a minimum speed threshold, and (iii) the HC sensor is on; and in response to the detecting, perform the cold start of the engine by controlling at least one of the purge pump and the purge valve, based on the measured amount of HC, to deliver a desired amount of fuel vapor to the engine, wherein delivery of the desired amount of fuel vapor during the cold start of the engine decreases HC emissions by the engine.

2. The system of claim 1, wherein one of the set of cold start preconditions is an ambient temperature being less than the cold start threshold.

3. The system of claim 2, wherein the cold start threshold is approximately 4 to 10 degrees Celsius.

4. The system of claim 1, wherein one of the set of cold start preconditions includes the measured amount of HC being greater than a threshold indicative of a minimum amount of HC for performing the cold start of the engine.

5. The system of claim 1, wherein the controller is further configured to perform the cold start of the engine by commanding fuel injectors of the engine to supply liquid fuel to the engine in addition to the desired amount of fuel vapor.

6. The system of claim 5, wherein the controller is configured to command the fuel injectors to operate at a minimum pulse width when performing the cold start of the engine.

7. The system of claim 1, wherein the controller is further configured to, after performing the cold start of the engine, command fuel injectors of the engine to supply a desired amount of liquid fuel to the engine.

8. The system of claim 7, wherein the controller is further configured to, after performing the cold start of the engine, control at least one of the purge pump and the purge valve to deliver fuel vapor to the engine in addition to the desired amount of liquid fuel via the fuel injectors.

9. A method for hydrocarbon (HC) vapor start of an engine, the method comprising:

detecting, by a controller, an imminent cold start of the engine by detecting a set of cold start preconditions that are each indicative of the imminent cold start of the engine, wherein one of the set of cold start preconditions includes (i) a key-on event has occurred that is indicative of an engine-off to engine-on transition, (ii) the purge pump has spooled to greater than a minimum speed threshold, and (iii) the HC sensor is on; and in response to detecting the imminent cold start of the engine:

receiving, by the controller and from a hydrocarbon (HC) sensor, a measured amount of HC in fuel vapor in fuel vapor being pumped by a purge pump from a vapor canister to the engine via a vapor line and a purge valve when engine vacuum is less than an appropriate level for delivering fuel vapor to the engine; and performing, by the controller, the cold start of the engine by controlling at least one of the purge pump and the purge valve, based on the measured amount of HC, to deliver a desired amount of fuel vapor to the engine, wherein delivery of the desired amount of fuel vapor during the cold start of the engine decreases HC emissions by the engine.

10. The method of claim 9, wherein one of the set of cold start preconditions is an ambient temperature being less than the cold start threshold.

11. The method of claim 10, wherein the cold start threshold is approximately 4 to 10 degrees Celsius.

12. The method of claim 9, wherein one of the set of cold start preconditions includes the measured amount of HC being greater than a threshold indicative of a minimum amount of HC for performing the cold start of the engine.

13. The method of claim 9, wherein performing the cold start of the engine further comprises commanding, by the controller, fuel injectors of the engine to supply liquid fuel to the engine in addition to the desired amount of fuel vapor.

14. The method of claim 13, wherein commanding the fuel injectors includes commanding the fuel injectors to operate at a minimum pulse width when performing the cold start of the engine.

15. The method of claim 1, further comprising, after performing the cold start of the engine, commanding, by the controller, fuel injectors of the engine to supply a desired amount of liquid fuel to the engine.

16. The method of claim 15, further comprising, after performing the cold start of the engine, controlling, by the controller, at least one of the purge pump and the purge valve to deliver fuel vapor to the engine in addition to the desired amount of liquid fuel via the fuel injectors.

17. The system of claim 1, wherein the desired amount of HC is based on a catalyst light-off temperature.

18. The system of claim 1, wherein the controller is configured to perform coordinated control of the purge pump and the purge valve to deliver the desired amount of fuel vapor to the engine prior to cranking of the engine.

19. The system of claim 18, wherein the controller is further configured to decrease a liquid fuel injector pulse width while performing coordinated control of the purge pump and the purge valve to compensate for the desired amount of fuel vapor.

* * * * *